US005463971A

United States Patent [19]

Abernethy

[11] Patent Number: 5,463,971

[45] Date of Patent: Nov. 7, 1995

[54] COLLAPSIBLE SEA ANCHOR OR DROGUE

[76] Inventor: William J. Abernethy, Woodville Lodge, RMB 128, Delegate, N.S.W., 2633, Australia

[21] Appl. No.: 244,697

[22] PCT Filed: Dec. 4, 1992

[86] PCT No.: PCT/AU92/00653

§ 371 Date: Jul. 7, 1994

§ 102(e) Date: Jul. 7, 1994

[87] PCT Pub. No.: WO93/11029

PCT Pub. Date: Jun. 10, 1993

[30] Foreign Application Priority Data

Dec. 4, 1991 [AU] Australia ..... PK 9833

[51] Int. Cl.[6] ..... B63B 21/48

[52] U.S. Cl. ..... 114/311; 114/294

[58] Field of Search ..... 114/293, 294, 114/311, 234; 441/13, 11; 244/138 R, 1 TD; D12/215

[56] References Cited

U.S. PATENT DOCUMENTS

| | | | |
|---|---|---|---|
| 396,229 | 1/1889 | Pagan | 114/311 |
| 4,534,306 | 8/1985 | Rutten et al. | 114/311 |
| 4,766,837 | 8/1988 | Parish | 114/311 |
| 5,016,556 | 5/1991 | Abernethy | 114/311 |
| 5,241,922 | 9/1993 | Allen | 114/311 |

FOREIGN PATENT DOCUMENTS

| | | |
|---|---|---|
| 2115362 | 9/1983 | United Kingdom . |
| WO88/06117 | 8/1988 | WIPO . |

*Primary Examiner*—Stephen Avila
*Attorney, Agent, or Firm*—Edwin D. Schindler

[57] ABSTRACT

A collapsible sea anchor or drogue (50) having first and second hollow frusto-conical body parts (74, 80) which are made from strong flexible material, such as canvas. Four flexible lines (60, 62, 64, 66) connect the two body parts (74, 80) together and to a nose portion (52) to which a towing line can be connected. The sea anchor or drogue (50) is very effective in that the drag is large having regard to the diameter of the body parts (74, 80) and, moreover, it can be compactly stored when in a collapsed condition.

22 Claims, 3 Drawing Sheets

COLLAPSIBLE SEA ANCHOR OR DROGUE

This invention relates to an improved drogue or sea-anchor.

A device of this general description is described and illustrated in U.S. Pat. No. 4,969,413 and has a hollow rigid body for towing behind a vessel by a hawser connected to the leading end of the body. While this device functions satisfactorily there is a need for a device which can be compactly stored and is preferably lightweight.

An object of the invention is to provide a collapsible sea anchor or drogue.

According to the present invention there is provided a collapsible sea anchor or drogue comprising:

a first body portion which in an operative position has a hollow frusto-conical shape;

a second body portion which in an operative position has a hollow frusto-conical shape;

towing line coupling means for coupling a towing line thereto;

means for interconnecting the first body portion, the second body portion and the towing line coupling means such that the towing line coupling means is located forwardly of a narrower end of the first body portion and the second body portion is located adjacent to a wider end of the first body portion with a wider end of the second body located adjacent to said wider end of the first body;

characterised in that at least one of said first and second body portions is collapsible when in a non-operative position.

Preferably, both of said first and second body portions are collapsible when in non-operative positions.

Preferably said first and second body portions are made from flexible material.

Preferably the material comprises canvas or fabric.

Embodiments of the invention are shown, by way of illustrative example only, in the accompanying drawings, wherein.

Figure 3:
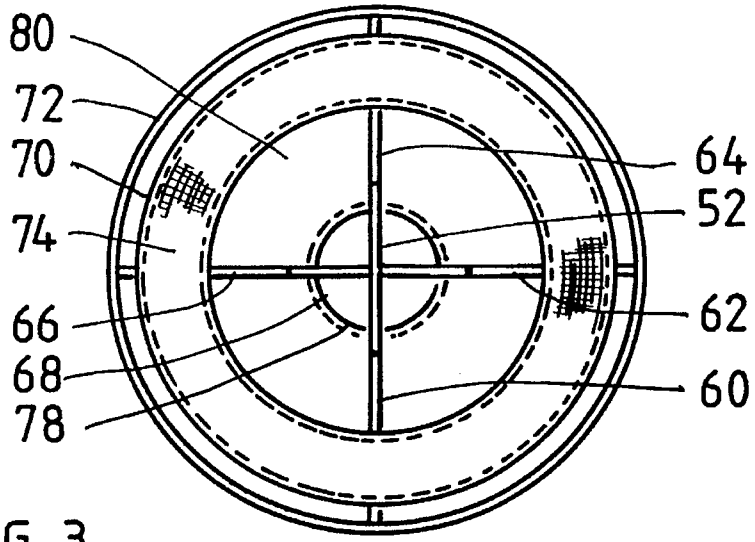
FIG. 3 is a front view of the embodiment of FIG. 1.
Figure 1:
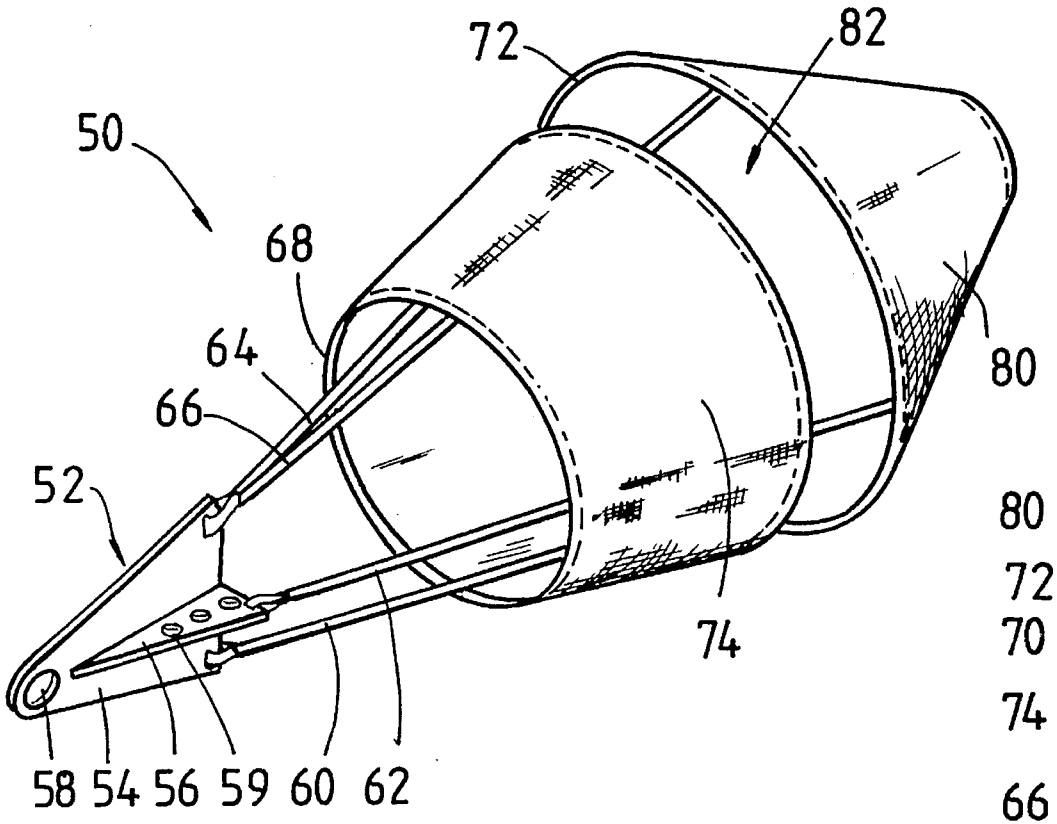
FIG. 1 is a perspective view of a preferred embodiment of the invention.
Figure 2:
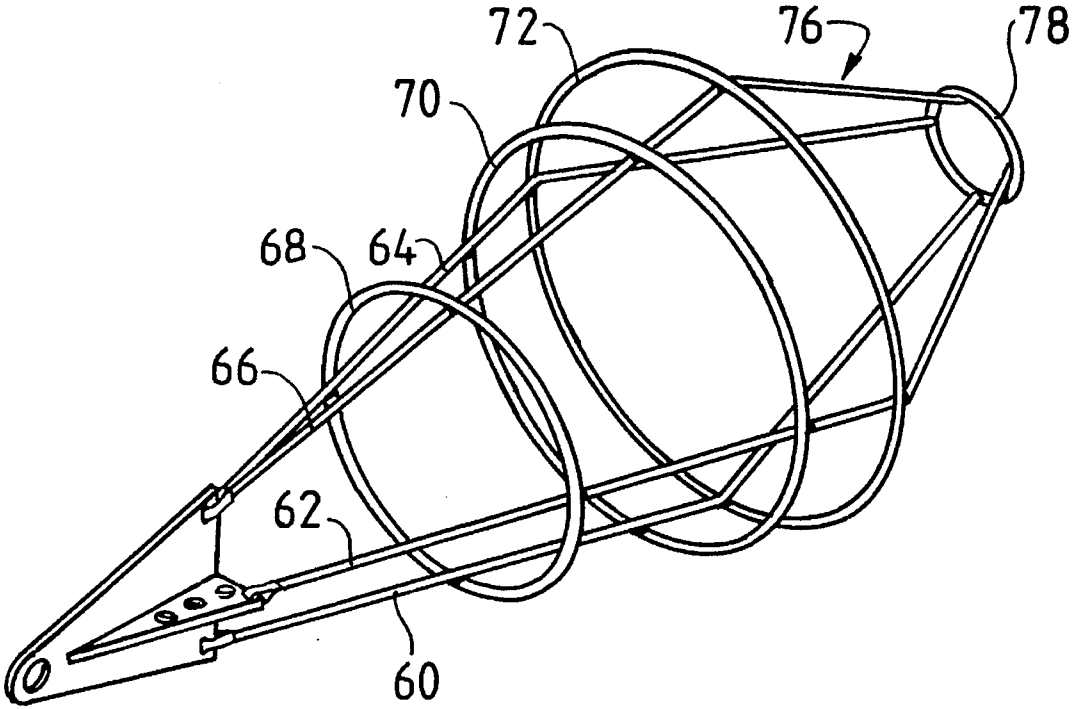
FIG. 2 is a fragmentary view of the embodiment of FIG. 1.
Figure 4:
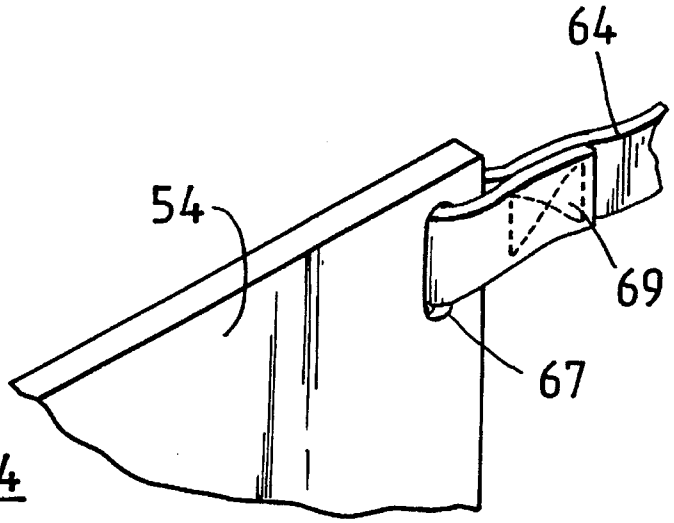
FIG. 4 is a fragmentary view of part of the embodiment of FIG. 1.

The drogue or sea anchor 50 of the invention includes a nose portion 52 which has vanes formed in a cruciform form shape so as to function as a paravane. The nose portion can be fabricated or moulded from metal or plastics material. The portion 52 includes a triangular plate 54 which forms a vane which would normally lie in a vertical plane. The portion 52 includes laterally extending vanes 56 which would normally lie in horizontal planes. The plate 54 includes an eyelet 58 to which a towing hawser (not shown) can be attached. Each of the laterally extending vanes 56 includes a number of eyelets 59 to which the hawser can be selectively attached so as to cause the sea anchor or drogue to track laterally from the towing point if desired. Extending rearwardly from the extremities of the vanes are four flexible lines 60, 62, 64 and 66. FIG. 4 illustrates one technique for connecting the lines to the nose portion 52. In this arrangement the ends of the vanes include slots 67 through which the lines are looped and fastened by means of stitching 69 or other fastening means.

Figure 5:
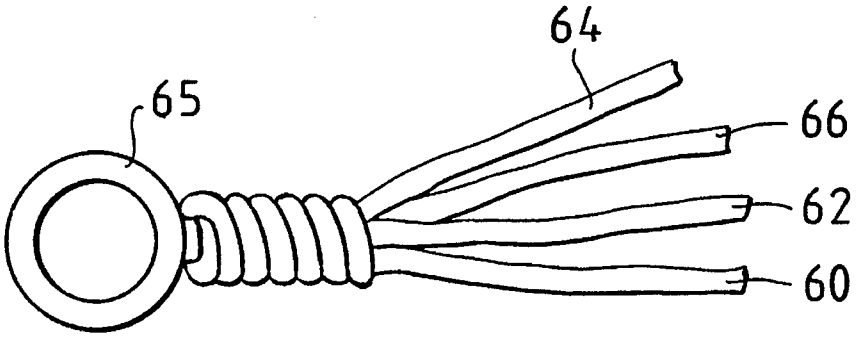
FIG. 5 is a fragmentary view of an alternative embodiment.

In an alternative embodiment shown schematically in FIG. 5 the front ends of the lines 60, 62, 64 and 66 could be spliced directly to an eyelet 65 to which the hawser is, in use, connected. The lines may comprise of webbing, metal cable or rope. The lines are connected to first, second and third rings 68, 70 and 72. The rings are preferably formed from stainless steel or galvanised steel. Alternatively the rings could be formed from rope, webbing or other flexible material. The diameter of the ring 68 relative to the ring 70 is chosen so that the lines 60, 62, 64 and 66 lie on a generally conical surface with the ring 68 approximately midway between the ring 70 and the eyelet 56. The rings 68 and 70 together with the lines form a support surface for a first frusto-conical cover 74 formed of flexible sheet material. The cover 74 is connected to the rings 68 and 70 and the lines by bonding and/or stitching. The material for the cover may comprise of canvas, flexible plastic sheet material or other strong flexible fabric.

The drogue or sea anchor includes a rear portion 76 which is generally frusto-conical in shape but having an oppositely directed taper to the forward part of the sea anchor. In the illustrated arrangement, the rearward ends of the lines 60, 62, 64 and 66 are connected to a small terminal ring 78. A second frusto-conical cover 80 is connected to and supported by the rings 72 and 78 and lines extending therebetween. The cover 80 again can be made from canvas, sheet plastics material or other strong flexible fabric. The cover 80 may include an end portion (not shown) which spans the ring 78 so as to close the rear end of the sea anchor or alternatively an opening may be left through the ring 78.

When the device of the invention is towed by means of a hawser coupled to the eyelet 58 or to one of the eyelets 59, water will enter the forward end of the cover 74 and then be ejected through water outlets 82 formed by the gap between the covers 74 and 80. A small proportion of the water will be discharged through the terminal ring 78. The drag which is created when the device of the invention is towed through the water generally speaking depends upon the diameter of the device and the speed with which it is towed. Generally speaking, for larger diameters and larger speeds the drag is greater. With the device of the invention, the lateral discharge of water through the outlets 82 increases the effective diameter of the device because the water flowing past the device must be further laterally displaced owing to the water discharging through the outlets 82. Thus, the passing water has increased speed and more turbulence owing to the effect of the discharge through the openings 82. As indicated earlier, the effect of these factors is to provide a drag greater than that which would normally be obtained from a conventional sea anchor or drogue of the same nominal diameter.

Figure 6:
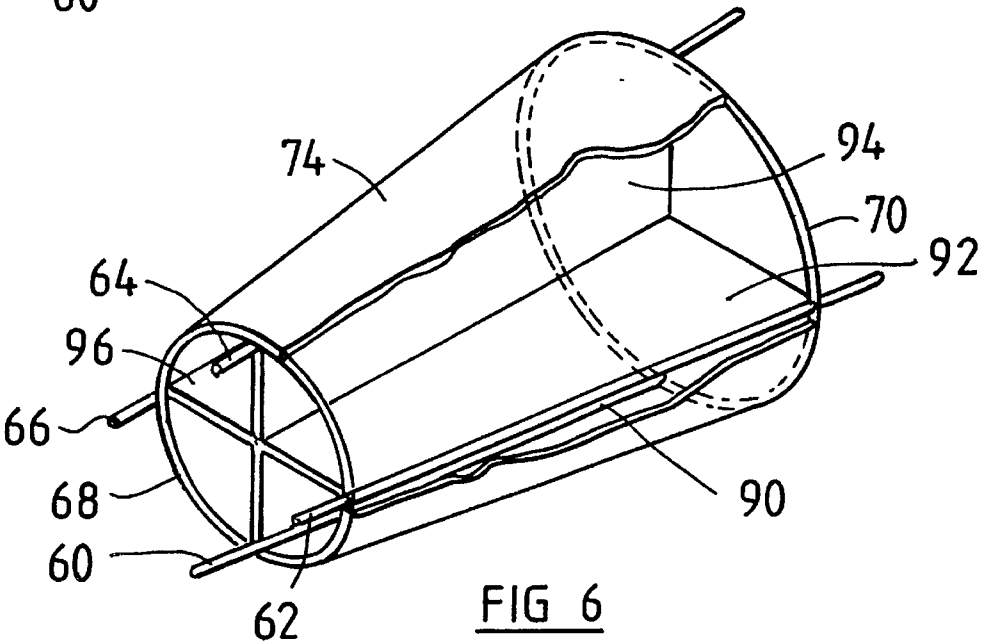
FIG. 6 is a fragmentary view of a further alternative embodiment.

FIG. 6 illustrates a further modification of the invention. In this case the stabilising vanes are formed within the first cover 74. More particularly, FIG. 6 shows four fabric panels 90, 92, 94 and 96 arranged in a generally cruciform shape and having an axis which is concentric with the axis of the frusto-conical cover 74. The panels can be stitched together and to the adjacent edges of the cover 74 or directly to the lines 60, 62, 64 and 66. When water enters the forward end of the cover 74 the panels will function as guide vanes to keep the sea anchor or drogue tracking in a stable manner. The nose of this device would normally be as shown in FIG. 5. Alternatively a nose portion 52 with vanes could also be used in this arrangement. The provision of the panels within the cover 70 is advantageous because stabilising vanes can be provided without adding significantly to the bulk of the device because the panels can be folded flat when the device is not in use.

In a further modified arrangement, the rear portion 76 of the sea anchor or drogue could be made as a hollow rigid body for instance of pressed metal or moulded plastics material which is connected to the lines 60, 62, 64 and 66 or otherwise connected to the forward cover 74. In this arrangement the nose portion 52; lines 60, 62, 64 and 66; cover 74 and rings 68 and 70 can conveniently be stored within the interior of the rear portion 76. Similarly the forward portion could also be made as a hollow rigid body. These arrangements are suited to uses where space is less critical.

The drogue or sea anchor of the invention can be used to assist in stabilising a vessel under power running before a sea and also as a sea anchor for a vessel without power, or for a multi-hull sailing vessel in adverse weather conditions, when streamed from the windward side, to prevent lift of the windward hull and impart stability to the vessel. Because the device of the invention can be compactly stored, it is ideal for use in life boats, life rafts and racing yachts where the provision of lightweight and compact equipment is very important.

A tripping line (not shown) could be incorporated in the device and this would function in the usual way. It would normally pass through an opening in the body 52, run externally of the device and be coupled to the ring 78. Pulling the line will collapse the device and make it easier to pull back to the towing vessel.

A prototype device has been made and found to perform very well. The prototype has the following dimensions:

| | |
|---|---|
| diameter of ring 68: | 36 cm |
| diameter of ring 72: | 60 cm |
| diameter of ring 78: | 7.5 cm |
| overall length: | 170 cm |
| axial length of cover 74: | 46 cm |
| axial length of cover 80: | 53 cm |
| axial length of gap 82: | 7.5 cm |

These dimensions can be varied to suit requirements.

The embodiments of the invention herein described and illustrated by way of example only may be subject to many modifications of constructional detail and design within the ambit of the invention.

What is claimed is:

1. A collapsible sea anchor or drogue comprising:

a first body portion which in an operative position has a hollow frusto-conical shape;

a second body portion which in an operative position has a hollow frusto-conical shape;

towing line coupling means for coupling a towing line thereto;

means for interconnecting the first body portion, the second body portion and the towing line coupling means such that the towing line coupling means is located forwardly of a narrower end of the first body portion and the second body portion is located adjacent to a wider end of the first body portion with a wider end of the second body located adjacent to said wider end of the first body;

characterised in that at least one of said first and second body portions is collapsible when in a non-operative position.

2. A collapsible sea anchor or drogue comprising:

a first body portion which in an operative position is hollow and tapers towards a forward direction of the sea anchor or drogue;

a second body portion which in an operative position is hollow and tapers towards a rear direction of the sea anchor or drogue;

towing line coupling means for coupling a towing line to a forward part of the first body portion;

means for interconnecting the first body portion, the second body portion and the towing line coupling means such that the towing line coupling means is located forwardly of a narrower end of the first body portion and the second body portion is located adjacent to a wider end of the first body portion with a wider end of the second body located adjacent to said wider end of the first body;

characterized in that at least one of said first and second body portions is collapsible when in a non-operative position.

3. A sea anchor or drogue as claimed in claim 1 wherein both of said first and second body portions are collapsible when in non-operative positions.

4. A sea anchor or drogue as claimed in claim 1 wherein said means for interconnecting comprises a plurality of flexible lines.

5. A sea anchor or drogue as claimed in claim 1 including rings located at the ends of the first and second body portions.

6. A sea anchor or drogue as claimed in claim 1 wherein there is a gap between the wider ends of the first and second body portions, said gap defining water outlets for discharging in use water generally laterally of the sea anchor or drogue.

7. A sea anchor or drogue as claimed in claim 1 wherein the narrower end of the second body portion is closed.

8. A sea anchor or drogue as claimed in claim 1 including vanes for imparting directional stability to the sea anchor or drogue as it is towed through water.

9. A sea anchor or drogue as claimed in claim 8 wherein the vanes are located on a nose body which incorporates said coupling means.

10. A sea anchor or drogue as claimed in claim 8 wherein vanes are located within the first body portion.

11. A sea anchor or drogue as claimed in claim 10 wherein the vanes are formed from perpendicular panels of fabric (90,92,94,96) connected within the first body portion or the second body portion.

12. A sea anchor or drogue as claimed in claim 1 wherein said second body portion comprises a non-collapsible body.

13. A sea anchor or drogue as claimed in claim 2, wherein both of said first and second body portions are collapsible when in non-operative positions.

14. A sea anchor or drogue as claimed in claim 2, wherein said means for interconnecting comprises a plurality of flexible lines.

15. A sea anchor or drogue as claimed in claim 2 including rings located at the ends of the first and second body portions.

16. A sea anchor or drogue as claimed in claim 2, wherein there is a gap between the wider ends of the first and second body portions, said gap defining water outlets for discharging in use water laterally of the sea anchor or drogue.

17. A sea anchor or drogue as claimed in claim 2, wherein the narrower end of the second body portion is closed.

18. A sea anchor or drogue as claimed in claim 2, including vanes for imparting directional stability to the sea anchor or drogue as it is towed through water.

19. A sea anchor or drogue as claimed in claim 18 wherein the vanes are located on a nose body which incorporates said coupling means.

20. A sea anchor or drogue as claimed in claim 18 are located within the first body portion.

21. A sea anchor or drogue as claimed in claim 20, wherein the vanes are formed from perpendicular panels of fabric connected within the first body portion or the second body portion.

22. A sea anchor or drogue as claimed in claim 2, wherein said second body portion comprises a non-collapsible body.

* * * * *